US007097542B2

(12) United States Patent
Skocypec et al.

(10) Patent No.: US 7,097,542 B2
(45) Date of Patent: Aug. 29, 2006

(54) METHOD AND APPARATUS FOR CONDITIONING A POLISHING PAD

(75) Inventors: Randy S. Skocypec, Gilbert, AZ (US); Adam P. La Bell, Chandler, AZ (US); Wade R. Whisler, Chandler, AZ (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 10/899,678

(22) Filed: Jul. 26, 2004

(65) Prior Publication Data

US 2006/0019583 A1 Jan. 26, 2006

(51) Int. Cl.
*B24B 1/00* (2006.01)
*B24B 21/18* (2006.01)
*B24B 33/00* (2006.01)

(52) U.S. Cl. ..... 451/56; 451/443; 451/444

(58) Field of Classification Search ..... 451/443, 451/44, 285–289, 444
See application file for complete search history.

(56) References Cited

U.S. PATENT DOCUMENTS 2,367,857 A * 1/1945 Findlater ..... 125/11.01
2,662,519 A * 12/1953 Metzger ..... 451/443
5,216,843 A * 6/1993 Breivogel et al. ..... 451/285
5,547,417 A * 8/1996 Breivogel et al. ..... 451/58
5,626,509 A * 5/1997 Hayashi ..... 451/285
6,027,659 A 2/2000 Billett
6,159,087 A * 12/2000 Birang et al. ..... 451/526
6,213,856 B1 4/2001 Cho et al.
6,270,396 B1 8/2001 Uchiyama
6,273,798 B1 * 8/2001 Berman ..... 451/72
6,402,883 B1 * 6/2002 Billett ..... 156/345.12
6,551,176 B1 4/2003 Garretson
6,945,857 B1 * 9/2005 Doan et al. ..... 451/56
2002/0173234 A1 * 11/2002 Sung et al. ..... 451/21
2002/0194790 A1 12/2002 Wang et al.
2003/0139122 A1 * 7/2003 Lawing ..... 451/288

FOREIGN PATENT DOCUMENTS

EP 1 080 839 A2 3/2001

OTHER PUBLICATIONS

Rohm Haas, DiaGrid Pad Conditioners, Mar. 2005.*
PCT Int'l. Search Report, Int'l. Application No. PCT/US2005/024890, Int'l. filing date Jul. 15, 2005, mailing date Oct. 13, 2005, 12 pages.

* cited by examiner

*Primary Examiner*—Joseph J. Hail, III
*Assistant Examiner*—Bryan Muller
(74) *Attorney, Agent, or Firm*—Blakely, Sokoloff, Taylor & Zafman LLP

(57) ABSTRACT

A method and apparatus for polishing a thin film on a semiconductor substrate is described. A polishing pad is rotated and a wafer to be polished is placed on the rotating polishing pad. The polishing pad has grooves that channels slurry between the wafer and polishing pad and rids excess material from the wafer, allowing an efficient polishing of the surface of the wafer. The polishing pad smoothes out due to the polishing of the wafer and must be conditioned to restore effectiveness. A conditioning assembly with a plurality of diamonds is provided. The diamonds have predetermined angles that provide strength to the diamond. This allows for an optimal rotation speed and downward force in effective conditioning of the polishing pad, while reducing diamond fracture rate.

28 Claims, 7 Drawing Sheets

METHOD AND APPARATUS FOR CONDITIONING A POLISHING PAD

BACKGROUND OF THE INVENTION

1. Field of the Invention

The present invention relates generally to semiconductor wafer polishing apparatus and, more specifically, a conditioning assembly for a polishing pad of a semiconductor wafer.

2. Discussion of Related Art

Semiconductor chips are manufactured by forming consecutive layers on a semiconductor wafer substrate. Raised and recessed formations can create undulations in a film. The undulations have to be planarized to allow for further fabrication.

Layers are usually polished in a process known in the art as "chemical-mechanical polishing" (CMP). CMP generally involves the steps of placing a wafer on a polishing pad with the layer to be polished on an interface between the wafer and the polishing pad. The wafer and the polishing pad are then moved over one another. A slurry is introduced on-the polishing pad. The polishing pad has a textured surface so that movement of the wafer and the polishing pad over one another, in conjunction with the slurry, results in a gradual polishing of the layer.

After polishing a certain number of wafers, the material of the slurry and of the wafer eventually build up on the polishing pad so that the polishing pad becomes smooth. The smoothing of the polishing pad lessens the effectiveness on the surface of the wafer, resulting in a decrease in the polishing rate, or uneven polishing over the surface of the wafer. Therefore, conditioning of the polishing pad must occur.

The polishing pad is subsequently conditioned to redistribute the slurry. A conditioning assembly is moved over the surface of the polishing pad, contacting the surface of the polishing pad with a downward force. The conditioning of the polishing pad generates grooves therein, roughening the polishing pad and allowing for the effective removal of excess material, restoring the polishing feature of the polishing pad.

BRIEF DESCRIPTION OF THE DRAWINGS

The invention is described by way of example with reference to the accompanying drawings, wherein.

DETAILED DESCRIPTION

A method and apparatus for polishing a thin film on a semiconductor substrate is described. A polishing pad is rotated and a wafer to be polished is placed on the rotating polishing pad. The polishing pad has grooves that channels slurry between the wafer and polishing pad and rids excess material from the wafer, allowing an efficient polishing of the surface of the wafer. The polishing pad smoothes out due to the polishing of the wafer and must be conditioned to restore effectiveness. A conditioning assembly with a plurality of diamonds is provided. The diamonds have predetermined angles that provide strength to the diamond. This allows for an optimal rotation speed and downward force in effective conditioning of the polishing pad, while reducing diamond fracture rate.

1. Polishing System

Figure 1:
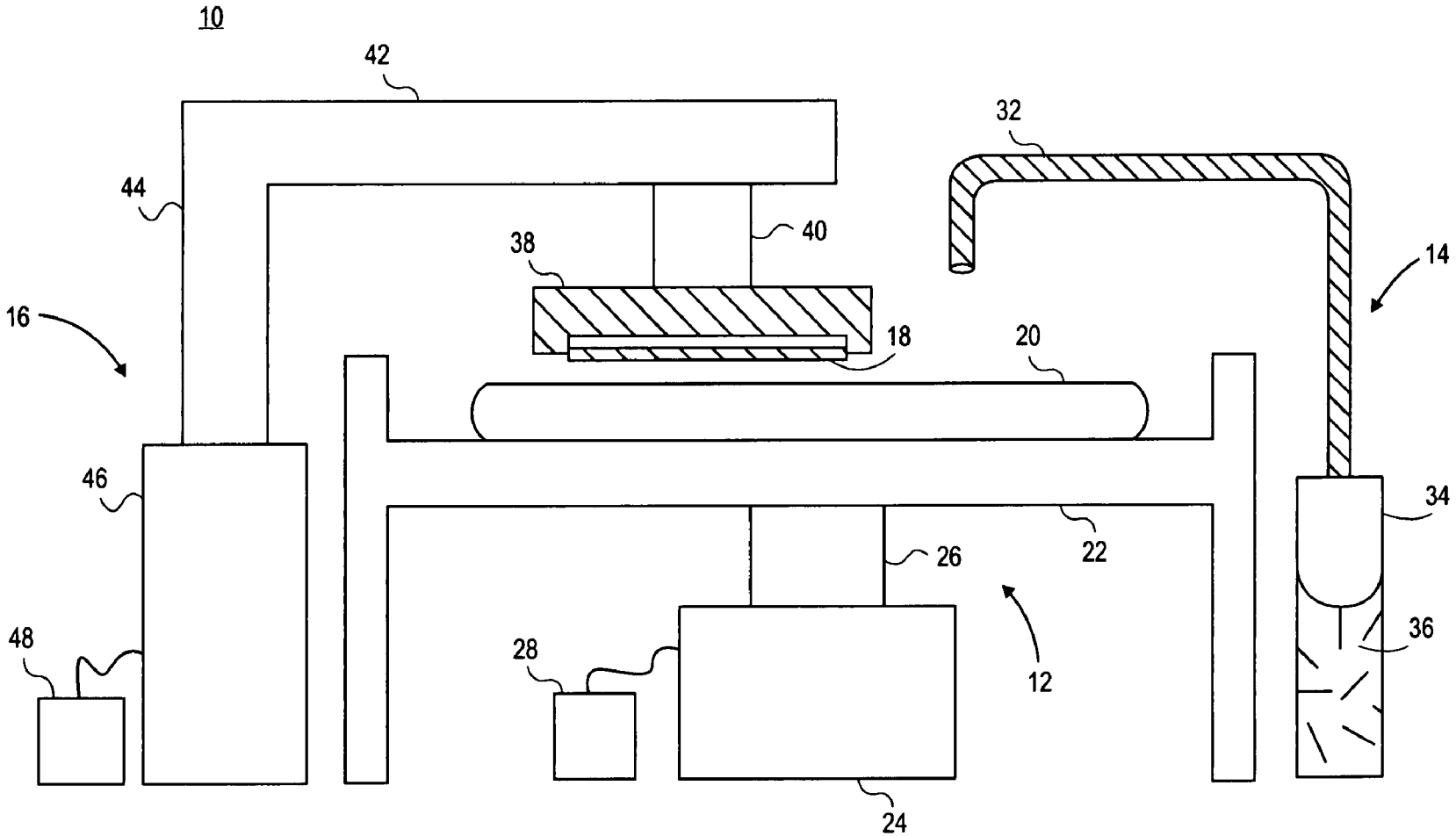
FIG. 1 is an illustration of a polishing apparatus with a polishing support system.

FIG. 1 of the accompanying drawings illustrates a polishing apparatus 10 while polishing a wafer 18. The polishing apparatus 10 includes a polishing support system 12, dispensing unit 14 and wafer support assembly 16 for a wafer 18.

The polishing support system 12 includes a polishing pad 20, a table 22, a rotary socket 24, a drive shaft 26 and electric motor 28. The polishing pad 20 is supported by the table 22 and is connected to the rotary socket 24 through the drive shaft 26. The rotary socket 24 is powered by the electric motor 28.

The dispensing unit 14 includes a pipe 32 and reservoir 34 holding slurry 36. The pipe 32 is connected to the reservoir 34 and extends over the polishing support system 12. The slurry 36 is delivered from the reservoir 34 to the polishing pad 20 during the polishing of the wafer 18.

The wafer support assembly 16 includes a retaining block 38, a rotary shaft 40, a directional arm 42, a connecting arm 44, a rotary unit 46 and an electric motor 48. The retaining block 38 secures the wafer 18 and is connected to the directional arm 42 by the rotary shaft 40. The directional arm 42 is connected to the connecting arm 44 and then to the rotary unit 46, which is powered by an electric motor 48.

Figure 2:
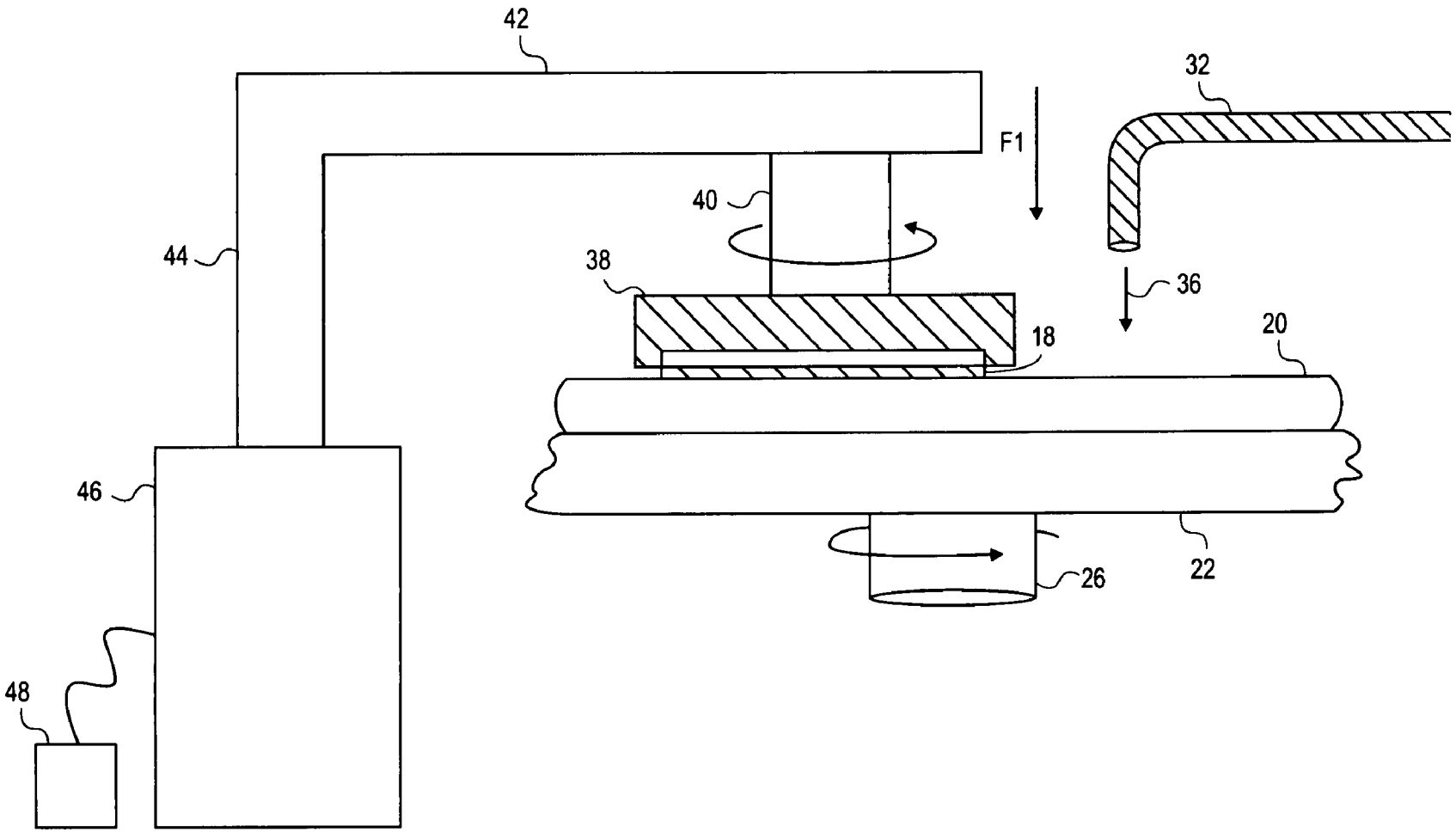
FIG. 2 is an illustration of the polishing apparatus in use polishing a wafer.

FIG. 2 illustrates the polishing apparatus 10, when the wafer 18 contacts the surface of the polishing pad 20. The polishing pad 20 is connected to the drive shaft 26, which is powered by the electric motor 28 through the rotary socket 24. Slurry 36 is dispensed from the pipe 32 via the reservoir 34 and onto the polishing pad 20. The wafer 18 contacts the polishing pad 20 and the slurry 36. The wafer 18 is supported by the retaining block 38, and is rotated by the rotary shaft 40, which is connected to the directional arm 42. The wafer 18 rotates over the rotating polishing pad, with an application of pressure F1 thereon, and with the slurry 36, the surface of the wafer undergoes polishing.

2. Conditioning System

After the polishing support system 12 polishes a certain number of wafers 18, the effectiveness of the polishing pad 20 is reduced. It is therefore recommended that the polishing pad 20 be conditioned in order to remain effective in the polishing of wafers 18. The polishing pad 20 can be conditioned by the conditioning system, before, during or after the polishing of the wafer 18.

Figure 3:
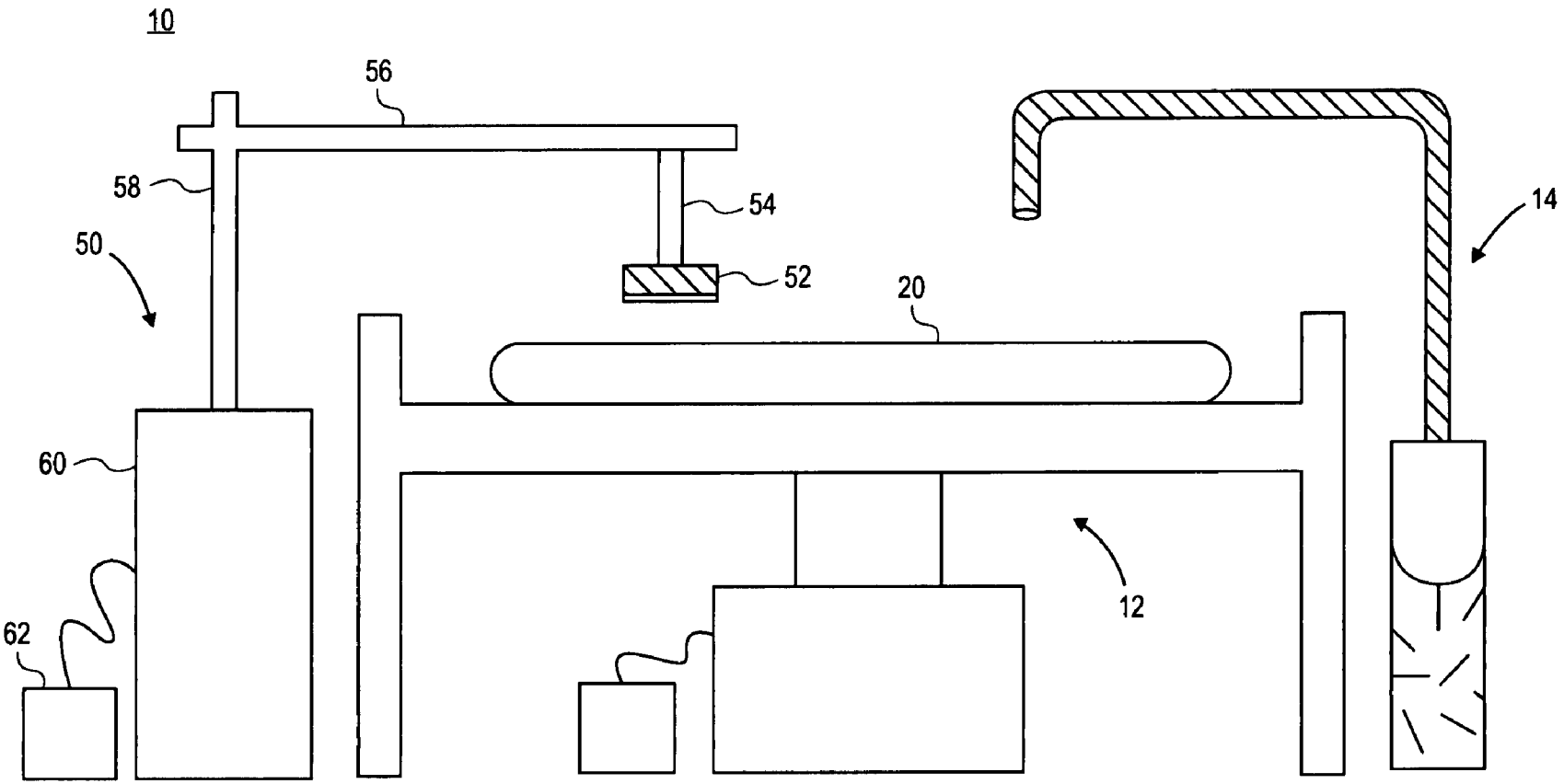
FIG. 3 is an illustration of the polishing apparatus with a conditioning unit.

FIG. 3 illustrates the polishing apparatus 10 in the conditioning of the polishing pad 20. The polishing apparatus 10 in addition to a polishing support system 12 and the dispensing unit 14 herein before described further includes a conditioning unit 50.

The conditioning unit 50 includes a conditioning assembly 52, a rotary shaft 54, a directional arm 56, a connecting arm 58, a rotary unit 60 and electric motor 62. The conditioning assembly 52 is connected to the directional arm 56 by the rotary shaft 54. The rotary unit 60 is connected to the directional arm 56 by the connecting arm 58, and is powered by the electric motor 62.

Figure 4A:
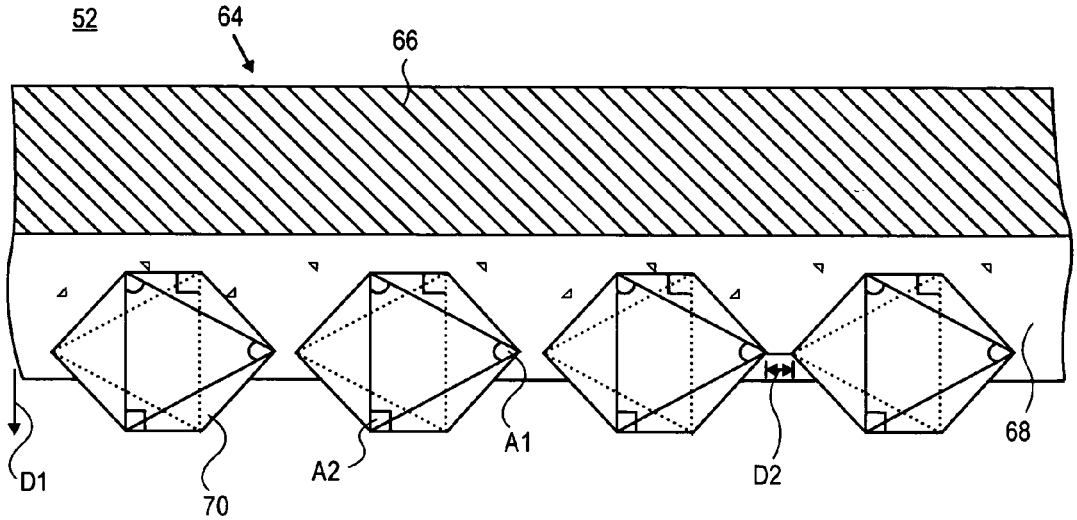
FIGS. 4*a* and 4*b* are cross sectional side views illustrating in detail the conditioning assembly and the plurality of diamonds therein.
Figure 4B:
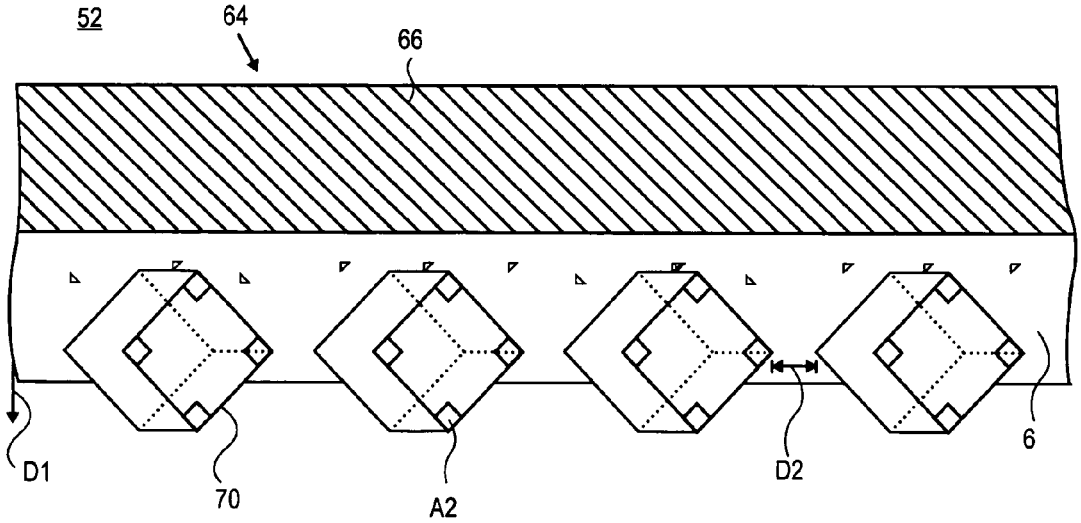

FIGS. 4*a* and 4*b* illustrate the components of the conditioning assembly 52 in more detail. The conditioning assembly 52 includes a base portion 64 and a plurality of diamonds 70. FIG. 4*a* illustrates one embodiment where the diamond 70 is octahedral and in another embodiment as illustrated in FIG. 4*b*, the diamond 70 is cubic.

The octahedral diamond 70 is comprised of eight sides, twelve edges and six vertices. In one embodiment the exterior angles A1 are 60 degrees, summed at 1440 degrees, interior angles form right angles A2 at 90 degrees. The cubic diamond is comprised of six sides forming right angles A2 and also includes twelve edges and six vertices, summed exteriorly at 2160 degrees.

The embodiments of diamond type provide necessary angles in determining the strength and durability of the diamond. The qualities obtained are that which is needed to effectively condition the polishing pad 20 using optimal processing conditions. Existing diamond conditioning pads use jagged or triangular type diamonds that are easily fractured. The fragments of which embed themselves into the polishing pad 20 and later scratch the surface of the wafer. Fractures provide inconsistent results in conditioning and are detrimental to the wafer 18 polishing.

The base portion 64 includes a first side 66 and a second side 68. The first side 66 connects with the rotary shaft 54, supporting the rotation of the conditioning assembly 52. The second side 68 has an adhesive bonding matrix material, manufactured by 3M Corp., that allows for the embedding of the plurality of diamonds 70 therein, promoting optimal distribution and protrusion for conditioning. The diamonds protrude between 50 and 90 microns from the base and in one embodiment the diamonds 70 protrude a distance D1 of 80 microns. In one embodiment 56 percent of the diamond 70 is randomly embedded within the adhesive 68, meaning any angle of the diamond may be protruding, leaving 44% protruding, generating optimal grooves within the polishing pad 20 in order to further connection between both slurry 36 and wafer 18.

The protrusion distance D1 of the diamond 70 effectively conditions the polishing pad by the generation of grooves of optimal depth into the polishing pad 20. The characteristic is made possible by the integrity of the shape and its ability to withstand optimal processing conditions, maintaining a non-defect environment. Existing non-adjustable conditioners provide lesser intrusions into the polishing pad because the integrity of diamonds will not sustain the impact of the processing conditions, causing defects. Existing adjustable screw-type diamond conditioners fasten a triangular shaped diamond to threaded steel shanks and cannot allow for optimal depth because the integrity of the diamond will also be compromised.

The diamonds 70 are between 160 and 210 microns across and in one embodiment 180 microns. In one embodiment the diamonds 70 per area are at least 50 diamonds per centimeter squared. The number of diamonds 70 embedded into the matrix adhesive bonding material range between 150 and 900. In one embodiment a more effective range of 450 and 900 diamonds are embedded. In another embodiment approximately 600 diamonds are embedded in a one-inch diameter disk, evenly distributed, in one embodiment by distance D2 of 700 microns, creating diamonds per area of 200 diamonds per centimeter squared.

Existing adjustable screw-type conditioners contain four to five adjustable diamonds, which do not provide the proper coverage needed to effectively condition the polishing pad 20. Few diamonds equates to few grooves generated into the polishing pad. To effectively polish a wafer, slurry must contact the wafer surface, thus the fewer the grooves the lower the likelihood of slurry to wafer contact, hindering polishing.

Existing non-adjustable embedded conditioners use at least 3000 jagged type diamonds on a four to six inch diameter disk. While generating a large number of grooves into the polishing pad, the large diameter of disk remains unsuitable because its insufficient surface flatness and its inability to track surface variations across the polishing track left in the polishing pad. This conditioner tends to condition certain portions while leaving other portions unconditioned, thus reducing the effectiveness of wafer polishing. Also used in conjunction with large diameter disks is a large amount of force, between seven and ten pounds, this magnitude of force fractures the jagged type diamond commonly used, once more, reducing the effectiveness of wafer polishing.

Figure 5A:
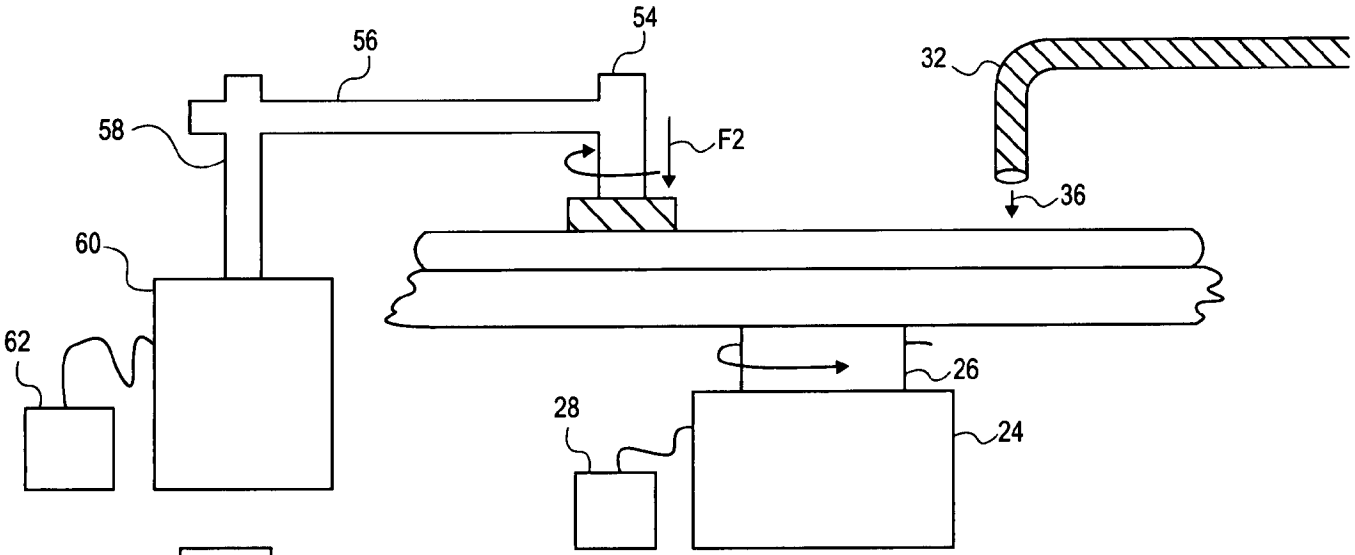
FIG. 5*a* is a side view of the polishing apparatus in use, conditioning a polishing pad.

FIG. 5*a* illustrates the polishing apparatus 10, when the conditioning assembly 52 contacts the surface of the polishing pad 20. The polishing pad 20 is connected to the drive shaft 26 and is rotated by the rotary socket 24. The rotary socket is powered by an electric motor 28, rotating the polishing pad 20. During polishing, the slurry 36 is dispensed from the pipe 32 via the reservoir 34 and onto the polishing pad 20. The conditioning assembly 52 contacts the polishing pad 20 with an applied downward pressure F2 and is rotated by the rotary shaft 54.

Figure 5B:
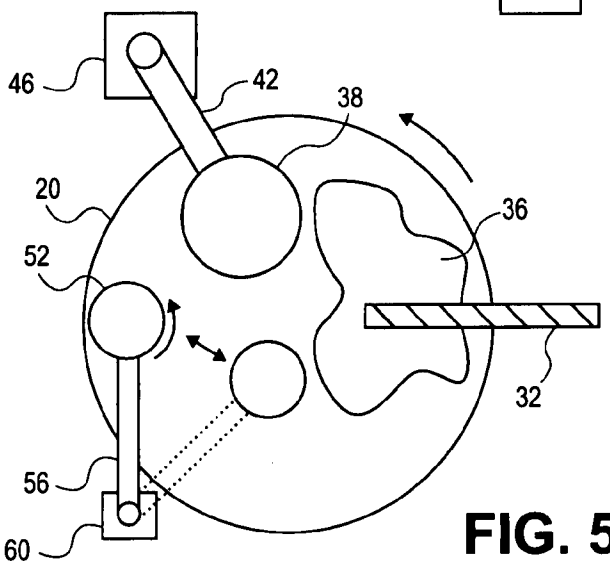
FIG. 5*b* is a top view of the polishing apparatus in FIG. 5*a*.

Reference is now made to FIG. 5*b*. As the polishing pad 20 rotates, the directional arm 56 is pivoted around a center point of the connecting arm 58 and directional arm connection, causing the conditioning assembly 52 to sweep across the polishing pad 20. The retaining block 38 houses the wafer 18 and is supported by the directional arm 42 and the rotary unit 46. The slurry 36 is deposited when polishing the wafer 18.

Figure 6:
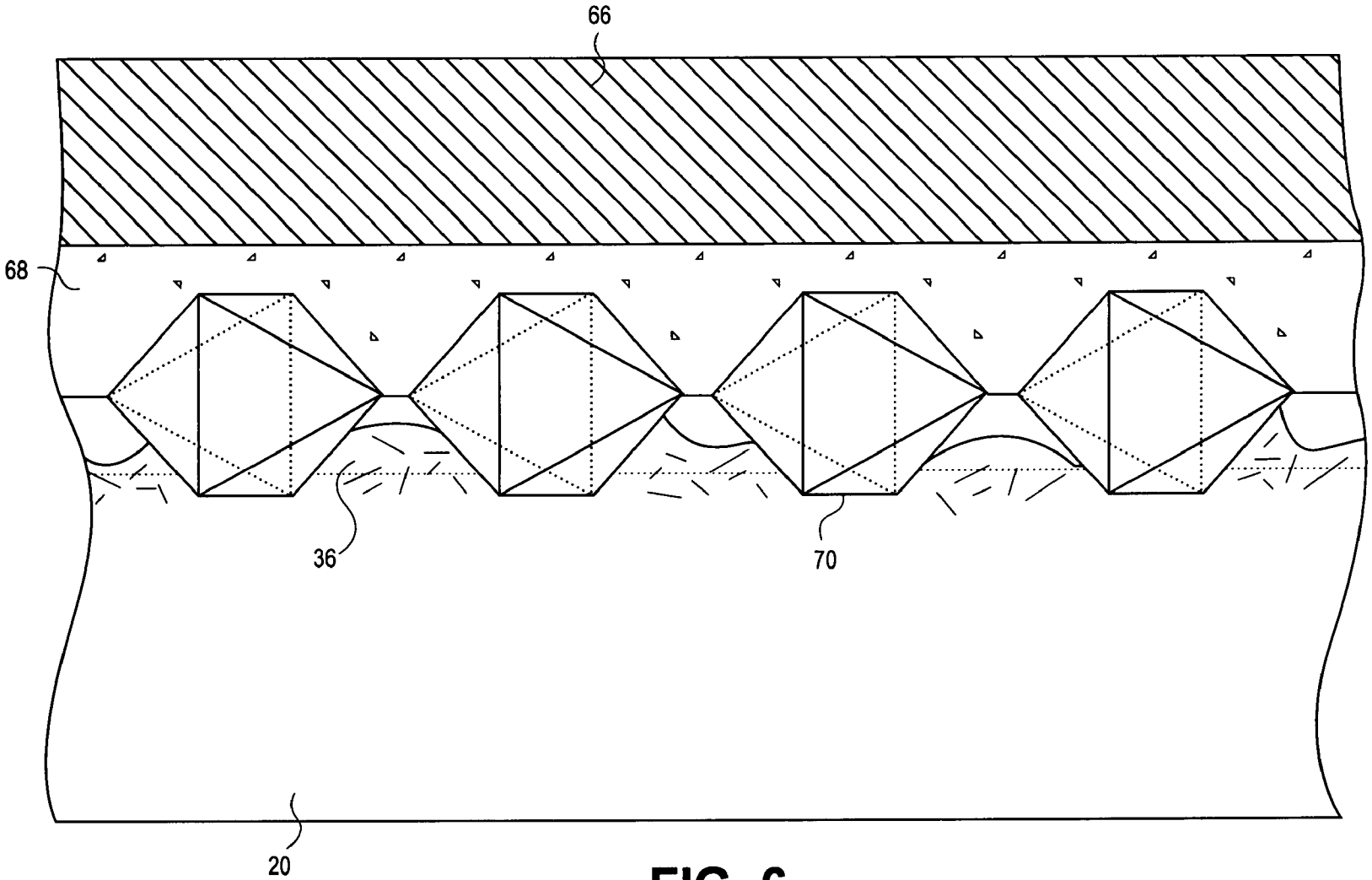
FIG. 6 is a cross sectional illustrating in detail the conditioning of the polishing pad.

FIG. 6 illustrates in more detail the scraping of the polishing pad 20 during conditioning. The diamonds 70 embedded within the second side 68 of the base portion contact the slurry 34 and the polishing pad 20. The diamonds 70 condition the slurry 34 and the polishing pad 20 by the generation of grooves that have a depth between 50 and 90 microns. In an embodiment the depth of the grooves are 80 microns. The grooves help polishing by channeling the slurry 36 between the polishing pad 20 and wafer 18 and allowing for excess material to be removed.

3. Processing Conditions

A plurality of diamonds 70 on the second side 68 of a conditioning assembly 52 condition the surface of the polishing pad 20 by the generation of grooves therein, this enables the polishing pad 20 to effectively polish the wafer 18 by channeling slurry 36 between the wafer 18 and the polishing pad 20 and allowing for excess material from the wafer to be removed, effectively planarizing the surface of the wafer 18.

Diamonds fracture during rotation of the conditioner and the fragments are known to embed in the polishing pad 20 and later scratch the surface of wafers that have undergone polishing. The diamonds 70 on the conditioning assembly 52 contain angles that optimize the integrity of the diamond. The octahedral or cubic shape of the embedded diamonds allow for optimal, revolutions per minute, distribution of diamonds, protrusion and generation of force F2 onto the polishing pad 20, this combined with optimal ratio of polishing pad 20 to conditioning assembly 52, leads to a decrease in fracture rate, more effective conditioning the polishing pad 20 and the subsequent polishing of the wafer 18.

Figure 7:
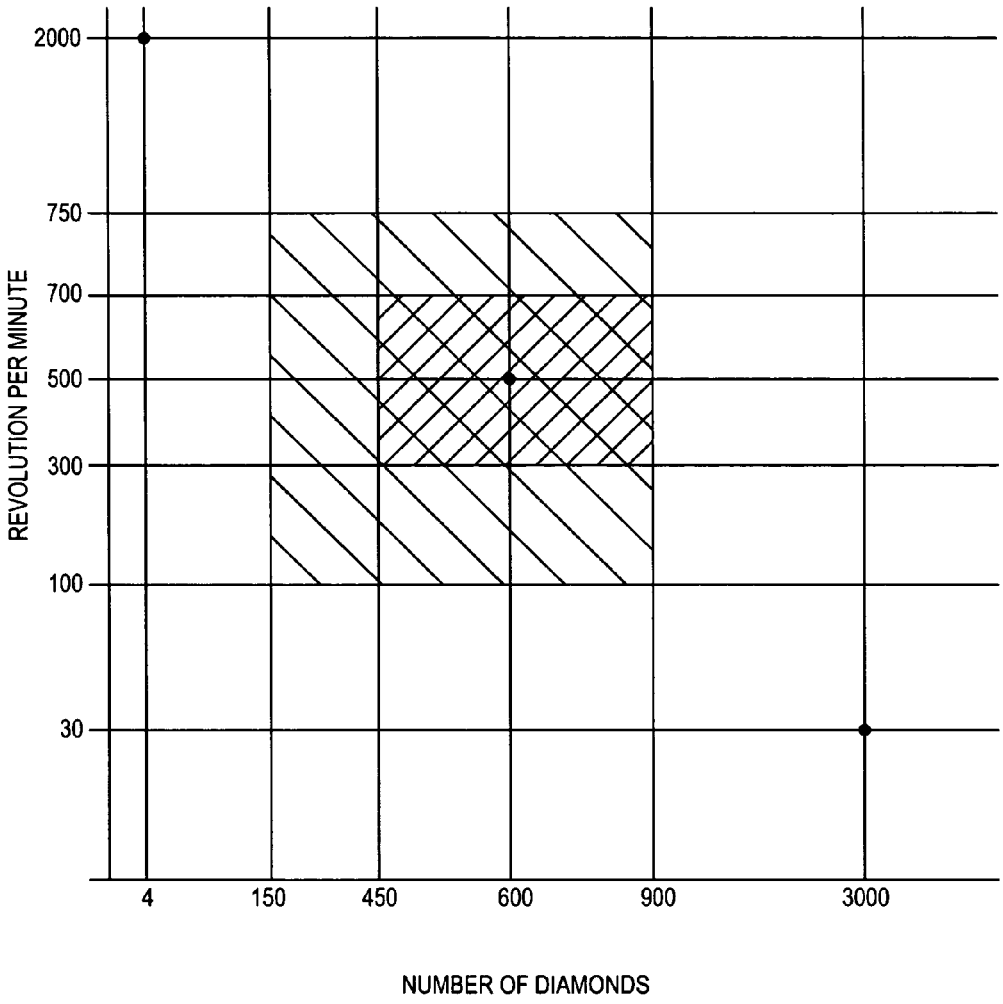
FIG. 7 is a graphical illustration of optimal processing parameters.

FIG. 7 illustrates to optimal processing parameters in order to generate effective conditioning of the polishing pad. In an embodiment the conditioning assembly has a range in diameter of 0.5 to 1.5 inches, maintaining a pad/conditioner ratio with the polishing pad between 1:13 and 1:40 and is rotated in a general range between 100 and 750 revolutions per minute, corresponding to general range between 150 and 900 of embedded diamonds and one to six pounds of downward force F2. In another embodiment, a more effective pad/conditioner ratio is between 1:16 and 1:26 and a range between 300 and 700 revolutions per minute is obtained, corresponding to a more effective range between 450 and 900 embedded diamonds. In another embodiment, conditioning is obtained by attaining 500 revolutions per minute, 600 embedded diamonds distributed on a 1 inch diameter disk with a downward force F2 of 1.175 lbs, maintaining a pad/conditioner ratio of 1:20, thus generating 0.37 pounds per square inch onto the polishing pad 20.

Existing non-adjustable conditioners are generally four to six inches in diameter, supplying a ratio between 1:3 and 1:4 with the polishing pad, revolving between 30 and 50 revolutions per minute, containing 3000 diamonds and application of force between seven and ten pounds, are insufficient in the conditioning of a polishing pad for several reasons.

The ratio between the conditioning and the polishing pad proves unsuitable because of its insufficient surface flatness and its inability to track surface variations across the polishing track left in the polishing pad, this provides a great deal of non-uniformity, a characteristic detrimental to the polishing of a wafer. The type of diamond used is easily fractured, so when the processing conditions are applied, defects can occur, decreasing the effectiveness of the polishing of a wafer. Currently the art is moving in a direction that increases the number of diamonds and force being applied to conditioners.

Existing adjustable screw-type conditioners are generally smaller in diameter, rotate at rates of 2000 revolutions per minute, containing between three and five adjustable diamond tips fastened to steel shanks. The amount of force is generally much less than that of the non-adjustable conditioners, but causes many of the same problems.

The amount and depth of grooves generated by the existing adjustable screw-type conditioner into the polishing pad decrease the interface between the wafer and the slurry, reducing polishing effectiveness. The diamonds generating the grooves are very few due to size and the ability of the components able to fit on a disk, and are also difficult to manufacture. The diamonds are able to adjust via screw-type steel shanks, but are not able to attain the depth desired due to the frailty and size of the diamond. At 2000 revolutions per minute and one pound of force, diamond fracture rate remains constant, reducing effectiveness of wafer polishing.

Conditioning pads refresh the polishing pad surface during CMP wafer processing to maintain a uniform pad surface. Polishing pad conditioning helps maintain optimal pad surface roughness and porosity ensuring slurry transport to the wafer surface and removal of CMP residuals. Without conditioning the pad surface will "glaze" and removal of oxides will rapidly decrease, hindering the polishing of the wafer.

A number of parameters will impact the CMP process and issues of ineffective conditioning remain. Diamond characteristics remain paramount and provide the ability to run optimal processing conditions. Embedding the diamonds, instead of fastening to steel threaded shanks, allows the conditioner to obtain the diamonds per area and protrusion desired. The integrity of a cubic or octahedral shaped diamond no longer allows the diamond to be the limiting factor in the processing equation as seen with jagged type diamonds used in existing conditioners, but allows optimal downward force and revolutions per minute to condition thoroughly and uniformly. Lastly, the small disk size is able to maintain surface flatness and track surface variations in the polishing pad, uniformly conditioning the polishing pad, thus increasing polishing output.

While certain exemplary embodiments have been described and shown in the accompanying drawings, it is to be understood that such embodiments are merely illustrative and not restrictive of the current invention, and that this invention is not restricted to the specific constructions and arrangements shown and described since modification may occur to those ordinarily skilled in the art.

What is claimed:

1. A conditioning assembly for polishing a semiconductor wafer, comprising:

a base with a first and a second side;

a plurality of diamonds on the second side, wherein the diamonds comprise a geometry having between six and eight sides and at least two 90 degree vertices, wherein each of the at least two 90 degree vertices is formed by two edges that meet to form an angle of about 90 degrees;

wherein the base has a diameter of between 0.5 and 1.5 inches;

wherein the plurality of diamonds includes between 150 and 900 diamonds;

wherein the diamonds are embedded within the base; and wherein the second set of vertices of the diamonds having any exterior angles of about 60 degrees or less are embedded in the base;

wherein only two of the at least two 90 degree vertices having angles of about 90 degrees protrude from the base and protrude from the base by an approximately equal amount; and wherein all other vertices located on the diamond are positioned below the surface of the base.

2. The conditioning assembly of claim 1, which includes approximately 600 diamonds.

3. The conditioning assembly of claim 1, wherein in the diamonds are octahedral.

4. The conditioning assembly of claim 1, wherein the diamonds are embedded within the base comprising a matrix adhesive bonding material.

5. The conditioning assembly of claim 1, wherein the diamonds protrude 50 to 90 microns from the base.

6. The conditioning assembly of claim 5, wherein the diamonds protrude 80 microns from the base.

7. The conditioning assembly of claim 1, wherein the diamonds are between 160 and 210 microns across.

8. The conditioning assembly of claim 7, wherein the diamond is 180 microns across.

9. The conditioning assembly of claim 1, wherein the spacing between each diamond is at least 700 micrometers.

10. The conditioning assembly of claim 1, wherein the diamonds per area are at least 50 per centimeter squared.

11. The conditioning assembly of claim 1, wherein the diamonds protrude about 44% of their structure from the base.

12. A conditioning assembly for polishing a semiconductor wafer, comprising:

a base with a first and a second side;

a plurality of diamonds on the second side, wherein the diamonds comprise a geometry having between six and eight sides and at least two 90 degree vertices, wherein each of the at least two 90 degree vertices is formed by two edges that meet to form an angle of about 90 degrees;

wherein the diamonds are embedded within the base;

wherein the diamonds protrude about 44% of their structure from the base wherein the second set of vertices of the diamonds having any exterior angles of about 60 degrees or less are embedded in the base;

wherein only two of the at least two 90 degree vertices having angles of about 90 degrees protrude from the base and protrude from the base by an approximately equal amount: and wherein all other vertices located on the diamond are positioned below the surface of the base;

wherein the base has a diameter of between 0.5 and 1.5 inches; and wherein the conditioning assembly is capable of withstanding optimal processing conditions of applied force per diamond, heating related to cutting speed of the diamonds, and shear stresses on the diamonds, while maintaining a low defect environment.

13. The conditioning assembly of claim 12, wherein the diamonds are embedded within the base comprisina a matrix adhesive bonding material.

14. The conditioning assembly of claim 12, which includes between 150 and 900 diamonds.

15. The conditioning assembly of claim 12, which includes approximately 600 diamonds.

16. The conditioning assembly of claim 12, wherein the diamonds are octahedral.

17. A conditioning assembly for reconditioning a polishing pad, comprising:

a base with a first and a second side;

a plurality of diamonds on the second side, wherein the diamonds comprise a geometry having between six and eight sides and at least two 90 degree vertices, wherein each of the at least two 90 degree vertices is formed by two edges that meet to form an angle of about 90 degrees;

wherein the ratio of the base diameter to the polishing pad diameter is between 1:13 and 1:40;

wherein the base has a diameter of between 0.5 and 1.5 inches;

wherein the diamonds are embedded within the base; wherein only two of the at least two 90 degree vertices having angles of about 90 degrees protrude from the base and protrude from the base by an approximately equal amount: and wherein all other vertices located on the diamond are positioned below the surface of the base; and wherein the plurality of diamonds includes between 150 and 900 diamonds.

18. The conditioning assembly of claim 17, wherein the ratio of the base diameter to the polishing pad diameter is between 1:16 and 1:26.

19. The conditioning assembly of claim 17, wherein the ratio of the base diameter to the polishing pad diameter has a ratio approximately 1:20.

20. The conditioning assembly of claim 17, wherein the diamonds are embedded within the base comprising a matrix adhesive bonding material; and wherein the diamonds protrude about 44% of their structure from the base.

21. The conditioning assembly of claim 17, wherein the plurality of diamonds comprise cubic diamonds.

22. The conditioning assembly of claim 17, which includes approximately 600 diamonds.

23. A conditioning assembly for reconditioning a polishing pad, comprising:

a base with a first and a second side;

a plurality of diamonds on the second side, wherein the diamonds comprise a geometry having between six and eight sides and at least two 90 degree vertices, wherein each of the at least two 90 degree vertices is formed by two edges that meet to form an angle of about 90 degrees;

wherein the diamonds are embedded within the base;

wherein the diamonds protrude about 44% of their structure from the base;

wherein the second set of vertices of the diamonds having any exterior angles of about 60 degrees or less are embedded into the base;

wherein only two of the at least two 90 degree vertices having angles of about 90 degrees protrude from the base and protrude from the base by an approximately equal amount;

wherein all other vertices located on the diamond are positioned below the surface of the base;

wherein the base has a diameter of between 0.5 and 1.5 inches; and wherein the plurality of diamonds includes between 450 and 900 diamonds.

24. The conditioning assembly of claim 23, wherein the ratio of the base diameter to the polishing pad diameter is between 1:16 and 1:26.

25. The conditioning assembly of claim 23, wherein the ratio of the base diameter to the polishing pad diameter has a ratio approximately 1:20.

26. The conditioning assembly of claim 23, wherein the diamonds protrude 50 to 90 microns from the base.

27. The conditioning assembly of claim 23, wherein the diamonds are between 160 and 210 microns across.

28. The conditioning assembly of claim 23, wherein the average spacing between each diamond is at least 700 micrometers.

* * * * *

UNITED STATES PATENT AND TRADEMARK OFFICE

CERTIFICATE OF CORRECTION

PATENT NO. : 7,097,542 B2
APPLICATION NO. : 10/899678
DATED : August 29, 2006
INVENTOR(S) : Skocypec et al.

It is certified that error appears in the above-identified patent and that said Letters Patent is hereby corrected as shown below:

In column 1, at line 23, delete “on-the” and insert --on the--.
In column 7, at line 17, after “base” insert --;--.
In column 7, at line 24, delete “:” and insert --;--.
In column 7, at line 35, delete “comprisina” and insert --comprising--.

Signed and Sealed this

Sixth Day of November, 2007

JON W. DUDAS
*Director of the United States Patent and Trademark Office*